United States Patent [19]

Merry

[11] Patent Number: 4,617,176

[45] Date of Patent: Oct. 14, 1986

[54] CATALYTIC CONVERTER FOR AUTOMOTIVE EXHAUST SYSTEM

[75] Inventor: Richard P. Merry, White Bear Lake, Minn.

[73] Assignee: Minnesota Mining and Manufacturing Company, St. Paul, Minn.

[21] Appl. No.: 650,167

[22] Filed: Sep. 13, 1984

[51] Int. Cl.[4] ..... F01N 3/28

[52] U.S. Cl. ..... 422/179; 422/221

[58] Field of Search ..... 422/179, 180, 221, 222; 60/299, 301

[56] References Cited

U.S. PATENT DOCUMENTS

| | | | |
|---|---|---|---|
| 3,912,459 | 10/1975 | Kearsley | 422/179 |
| 3,916,057 | 10/1975 | Hatch et al. | 422/179 |
| 3,926,565 | 12/1975 | Birtigh et al. | 422/179 |
| 3,948,611 | 4/1976 | Stawsky | 422/179 |
| 4,004,888 | 1/1977 | Musall et al. | 422/179 |
| 4,163,042 | 7/1979 | Lynch | 422/179 |
| 4,344,921 | 8/1982 | Santiago et al. | 422/179 |
| 4,353,873 | 10/1982 | Noritake et al. | 422/179 |
| 4,385,135 | 5/1983 | Langer et al. | 106/286.5 |
| 4,397,817 | 8/1983 | Otani et al. | 422/231 |
| 4,413,392 | 11/1983 | Otani et al. | 422/179 |

*Primary Examiner*—David L. Lacey

*Attorney, Agent, or Firm*—Donald M. Sell; James A. Smith; Edward T. Okubo

[57] ABSTRACT

A catalytic converter having a monolithic ceramic catalytic element mounted within a metallic casing by a resilient flexible intumescent sheet having generally sinusoidal edges such that mounting pressure is applied to the lateral surface of the ceramic monolith in the area circumscribed by the generally sinusoidal edges is disclosed. Other methods for applying mounting pressure on the ceramic monolith are also disclosed.

6 Claims, 6 Drawing Figures

CATALYTIC CONVERTER FOR AUTOMOTIVE EXHAUST SYSTEM

BACKGROUND OF THE INVENTION

The present invention relates to a catalytic converter for use in an exhaust system of an automotive internal combustion engine and more particularly to a catalytic converter of the type having a metallic casing with a monolithic catalytic element securely but resiliently mounted within the casing by a resilient flexible intumescent sheet having generally sinusoidal edges such that mounting pressure is applied to the lateral surface of the ceramic monolith in the area circumscribed by the generally sinusoidal edges.

Catalytic converters are universally employed for oxidation of carbon monoxide and hydrocarbon and reduction of the oxides of nitrogen in automobile exhaust gases in order to control atmospheric pollution. Due to the relatively high temperatures encountered in these catalytic processes, ceramic has been the natural choice for catalyst supports. Particularly useful supports are provided by ceramic honeycomb structures as described, for example, in U.S. Pat. RE No. 27,747.

Ceramic bodies tend to be frangible and to have coefficients of thermal expansion differing markedly from the metal, usually stainless steel, containers. Thus, the mounting means of the ceramic body in the container must provide resistance to mechanical shock due to impact and vibration and to thermal shock due to thermal cycling. Both thermal and mechanical shock may cause deterioration of the ceramic support which, once started, quickly accelerates and ultimately renders the device useless. Intumescent sheets that have been found useful as mounting materials for this purposes are disclosed in U.S. Pat. Nos. 3,916,057 4,305,992, and U.K. Pat. No. 1,513,808.

It has been found that the above intumescent sheet materials may exert substantial pressures on the ceramic monoliths of catalytic converters. These pressures, combined with the shear modulus, the coefficient of friction and the coefficient of thermal expansion of the intumescent sheet material and the axial thermal expansion of the container may cause cracks within the ceramic monolith. These cracks are termed "ring off" cracks and occur perpendicularly to the gas flow usually near the center of the monolith. In severe cases, the ceramic monolith is completely severed into two pieces.

SUMMARY OF THE INVENTION

With presently available materials, a minimum mount or packing density of 0.6 gm/cc of intumescent sheet materials is required to hold the ceramic monolith in place during the normal operating conditions of the catalytic converter. However, due to the dimensional tolerances of the ceramic monolith (±1.02 mm), the metal casing (±0.05 mm) and the tolerances of the intumescent sheet materials (±10% wt/area), mount densities can frequently be 2 to 2.5 times the minimum mount density, i.e., 1.2–1.5 gm/cc. Under these high mounting density conditions and at increased operating temperatures, ring off cracking of the ceramic monolith occurs with great regularity. If the ceramic monolith is inherently weak, as in the case of the diesel particulate filters, ring off cracks will occur at mount densities even lower than used to mount the stronger conventional ceramic catalytic substrates. Ring off cracking in a diesel particulate filter monolith renders it useless. It is clear that intumescent sheet materials in their presently available forms may exert too much force particularly on fragile diesel particulate filter ceramic bodies. However, if the mount density of the intumescent sheet is reduced to eliminate ring off cracking, the support of the ceramic monolith may then be inadequate and catastrophic damage can result from the effects of vibration and thermal shock.

Efforts to reduce or eliminate ring off cracking of ceramic monoliths, particularly diesel particulate filter ceramic bodies, have included the use of special low density flexible intrumescent sheet materials such as disclosed in U.S. Pat. No. 4,385,135.

It has unexpectedly been found that by utilizing a conventional intumescent sheet provided with generally sinusoidal edges, the forces exerted on the ceramic monolith are moderated and detrimental ring off cracking of the monolith can be prevented while at the same time exerting sufficient force at lower mount densities to resist the thermal and vibrational conditions intrinsic in the operation of catalytic converters.

DETAILED DESCRIPTION OF THE INVENTION

Figure 1:
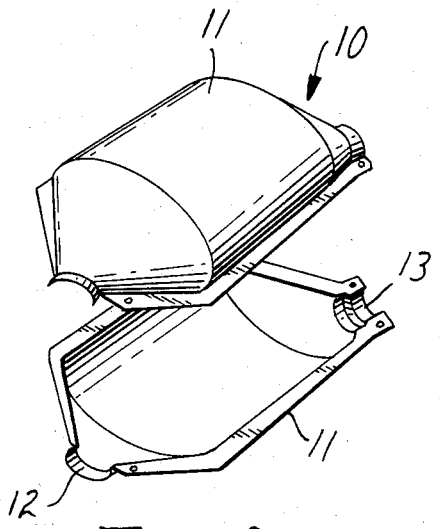
FIG. 1 is a perspective view of the shells of the metallic casing of a catalytic converter of the present invention shown in disassembled relation.
Figure 2:
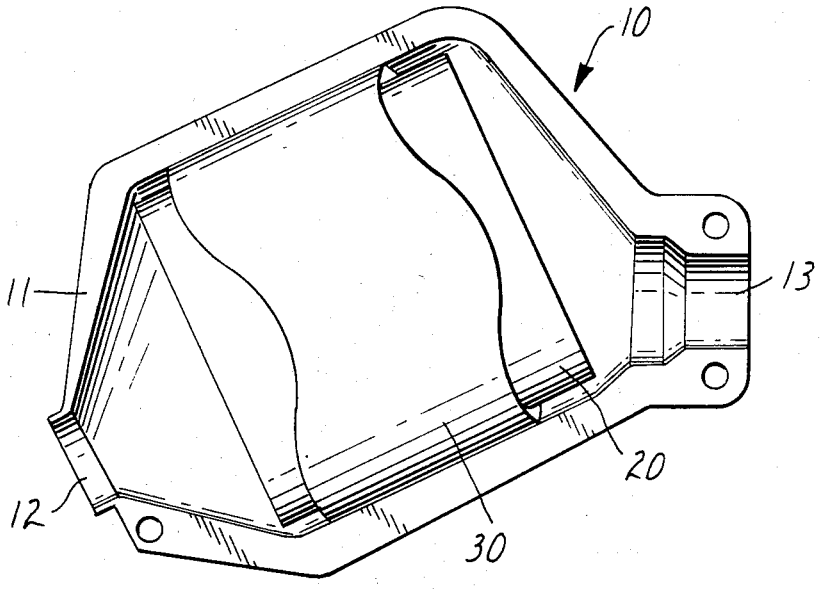
FIG. 2 is a plan view of the catalytic converter of FIG. 1.

Referring now to the drawings, catalytic converter 10 comprises metallic casing 11 with generally frustoconical inlet and outlet ends 12 and 13, respectively. Disposed within casing 11 is a monolithic catalytic element 20 formed of a refractory material such as ceramic and having a plurality of gas flow channels (not shown) therethrough. Surrounding catalytic element 20 is a sheet 30 of resilient flexible intumescent mounting sheet which serves to tightly but resiliently support catalytic element 20 within the casing 11 by expansion in situ. The expanded sheet then holds the catalytic element 20 in place in the casing and seals the peripheral edges of the catalytic element to thus prevent exhaust gases from by-passing the catalytic element.

During operation of the catalytic converter, the temperature of the assembly increases and the radial gap between the metal container and ceramic monolith increases due to the higher thermal expansion coefficient of the metal container. The thermal stability and resilience of the sheet after exfoliation compensate for the differences in thermal expansion of the metal canister and the ceramic substrate, for vibration transmitted to the fragile device and for irregularities in the metallic or ceramic surfaces.

The differential thermal expansion in the axial direction, however, can have a damaging effect on the ceramic monolith if the high temperature compression and shear moduli of the intumescent sheet exceed certain values. As the metal canister expands relative to the ceramic monolith, the intumescent sheet must shear or some other measure must be found to minimize transmission of strain and stress to the ceramic monolith, particularly when the gripping pressure and friction coefficient are both high.

It has now been found that the configuration of the edges of the intumescent sheet 30 can have a critical effect on the ability of the ceramic catalytic element 20 to withstand the thermal and other stresses imposed by the differential axial expansion between the metallic casing 11 and the ceramic catalytic element 20.

Various sheet configurations were tested to determine their efficacy in accomodating the differential expansion of the metallic casing in the axial direction to thereby minimize strain and stress transfer to the ceramic catalytic element. The configurations tested were: (a) rectangular, covering the lateral surface of the ceramic monolith; (b) rectangular, covering only the ends of the lateral surface of the ceramic monolith; (c) sinusoidal with the sine waves 180° out of phase along each edge; (d) sinusoidal with the sine waves in phase along each edge such that the waves are parallel; (e) perforated rectangular sheet with circular portions removed throughout the intumescent sheet and (f) generally sinusoidal with straight edged sine waves in phase resulting in a parallel zigzag pattern.

Figure 3:
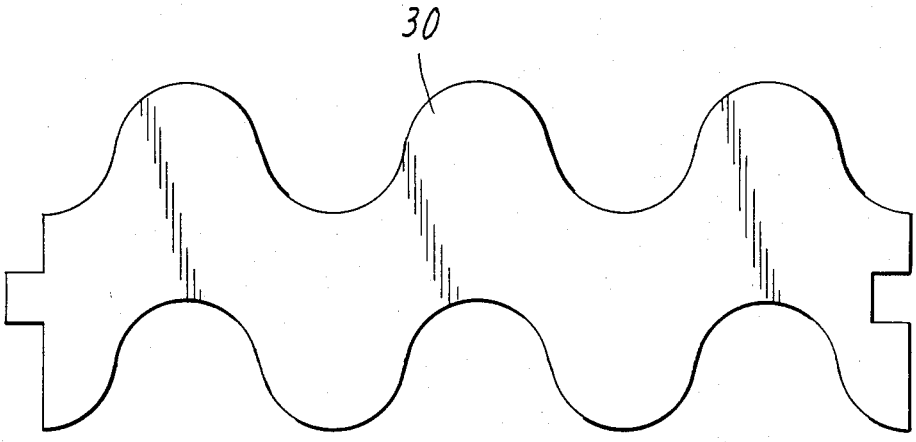
FIG. 3 is a plan view of the resilient flexible intumescent mounting sheet of FIG. 2 corrugated with a generally sinusoidal wave pattern along both its longitudinal edges.
Figure 4:
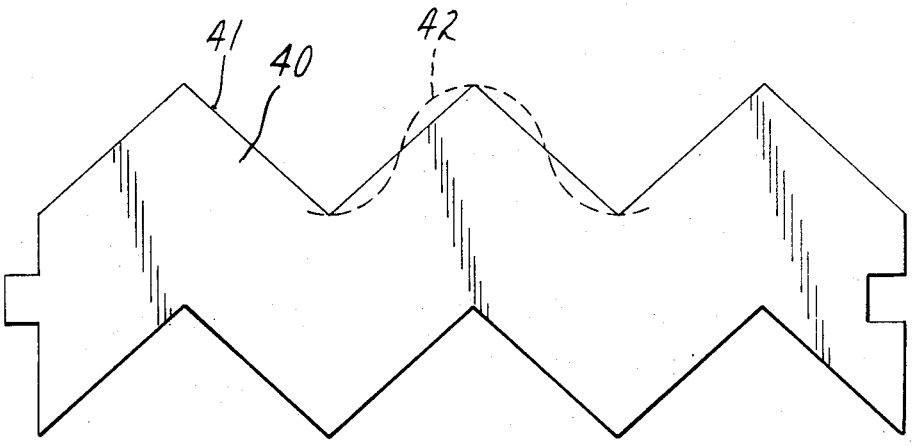
FIG. 4 is a plan view of another mounting sheet showing another form of generally sinusoidal corrugation.
Figure 5:
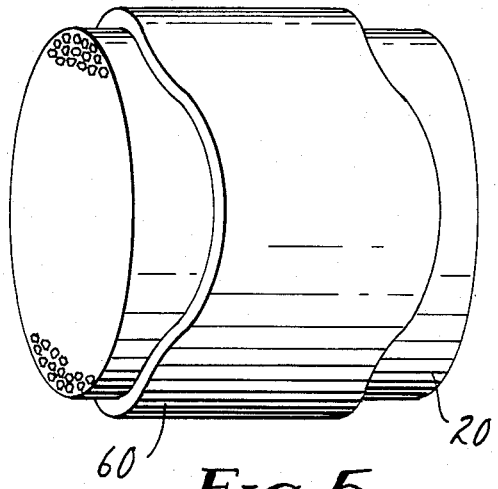
FIG. 5 is a perspective view of a monolithic catalytic element having a protrusion in a generally sinusoidal wave pattern molded on its lateral surface.
Figure 6:
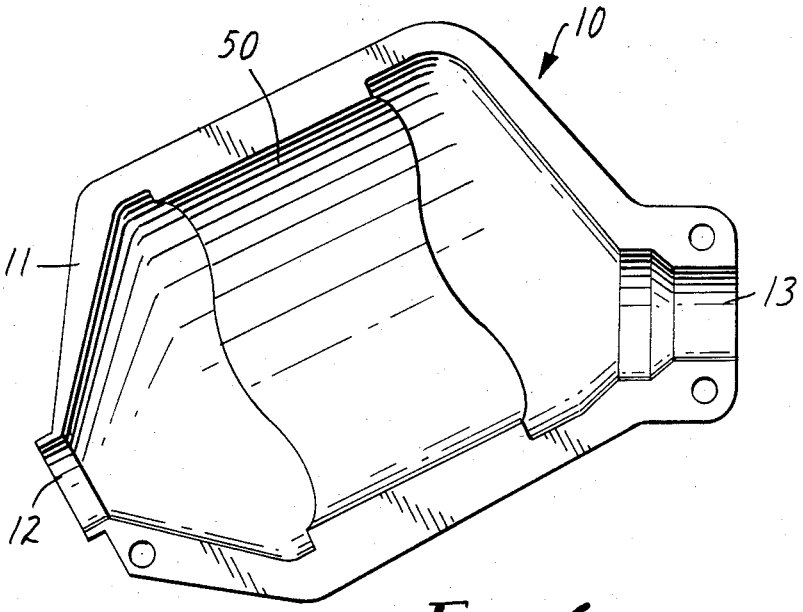
FIG. 6 is a plan view of the bottom shell of the metallic casing having an inwardly protruding generally sinusoidal wave pattern embossed therein.

As used herein the terms "sinusoidal" and "generally sinusoidal" are meant to include the sheet configurations shown in FIGS. 3 and 4 of the drawings. It will be apparent from an inspection of the drawings that the corrugations of the sheet 30 of FIG. 3 are true sine waves and that the corrugations of the sheet 40 of FIG. 4 are, in effect, sine waves with straight angular edges 41 rather than the usual curvilinear edges. It will be seen, however, that the straight angular edges 41 of sheet 40 digress only slightly from the "normal" curvilinear edges 42 of a true sine wave (shown in dotted lines in FIG. 4).

As a result of these tests, the preferred configuration of the intumescent sheet was thus found to be an elongate planar sheet corrugated with a sine wave pattern along both its lengthwise edges, the corrugations being generally parallel and regular and comprised of substantially equal ridges and hollows having a perimeter to frequency ratio in a range of 2.44 to 4.88 and amplitude in a range of 12 to 50% of the width of the sheet. As used herein, the term perimeter to frequency ratio means the perimeter of the ceramic monolith divided by the frequency of the sine wave along one edge of the intumescent mounting sheet. The sinusoidal edges of the intrumescent sheet 30 apparently function to distribute the vector forces in such a manner that the intumescent sheet can still expand sufficiently to not only tightly and resiliently support the catalytic element 20 within the casing 11 but also acts to spread the differential thermal expansion stress forces in the axial direction over a larger area and thus maintain the transmitted strain and stress below the tensile strength of the ceramic. While the operative mechanics involved are not known with certainty, it is clear that the differential expansion forces are being effectively accomodated since results obtained using the sinusoidal edged intumescent sheets of the present invention are quite spectacular in that no ring off cracking was observed even in catalytic converters involving mount densities as high as 1.3 g/cc.

A test was devised to determine the ability of various edge configurations on intumescent sheet materials to prevent ring off cracking of ceramic catalytic elements mounted in metallic canisters. For these tests, the intumescent sheet material was a standard state-of-the-art intumescent sheet material produced according to British Pat. No. 1,513,808. The metallic canister was a stainless steel canister (123.4 mm I.D.) and the ceramic catalytic element was a standard cylindrical ceramic core 152.4 mm long×118 mm diameter. The ceramic substrates were wrapped with the test intumescent sheet materials and mounted in the canister at various mount densities and connected to an exhaust gas simulator (made by RPS Engineering Co.). The exhaust gas simulator, using propane fuel, is run at an inlet gas temperature of 950° C. and 23 SCFM for 10 minutes. After 10 minutes at 950°, the propane gas is shut off and room air introduced at 72 SCFM. The air flow is continued until the can temperature drops to approximately 38° C. The unit is then disasembled and the substrate examined for cracks.

| Test | Mount Density | Area $cm^2$ | Configuration | Ring Off Crack |
|---|---|---|---|---|
| 1 | 0.68 | 593 | Rectangle | No |
| 2 | 0.81 | 593 | Rectangle | Yes |
| 3 | 0.80 | 593 | Rectangle | Yes |
| 4 | 1.27 | 446 | Rectangle | Yes |
| 5 | 1.31 | 397 | Rectangle | Yes |
| 6 | 1.18 | 397 | 2 Rectangles-ends covered | Yes |
| 7 | 1.25 | 297 | Sinusoidal- | No |
| 8 | 1.21 | 396 | edges 180° | No |
| 9 | 1.18 | 446 | out of phase | Yes |
| 10 | 1.27 | 397 | Sinusoidal- | No |
| 11 | 1.27 | 446 | edges in phase-perimeter: frequency ratio = 4.88 | No |
| 12 | 1.25 | 446 | Sinusoidal-edges in phase-perimeter: frequency ratio = 2.44 | No |
| 13 | 1.26 | 446 | Perforated rectangle | Yes |
| 14 | 1.27 | 446 | Sinusoidal zigzag | Yes |
| 15 | 1.20 | 446 | Sinusoidal zigzag | No |

The test data show that even for relatively high mount densities where ring off cracking was experienced using the conventional rectangular intumescent sheets of comparable areas, the sinusoidal edged sheets of the present invention prevented ring off cracking of the ceramic monoliths.

A hot vibration and water quenching test of converter mounting systems is used by automotive companies to simulate actual use on automobiles. This test consists of wrapping an oval substrate (11.8 cm long×15.24 cm wide×7.6 cm high) with test intumescent mounting material and placing the wrapped substrate between two metal clamshell type canister halves in which the mounting gaps were premeasured to be approximately 2.6 mm. The canister halves are pressed together and welded to complete the converter assembly. The converter assembly is connected to the exhaust of an eight cylinder engine for 30 minutes with the exhaust temperature controlled at 600° C. The hot converter is quenched with water for 30 seconds and reheated for 30 minutes. The quenching and heat cycles are repeated 20 times. After the water quench test, the converter is mounted in an Unholtz-Dickey vibrator and again connected to the eight cylinder engine. The test converter is then vibrated at 28 G's at 100 Hz in the following manner: (1) 5 hrs. @ 610° C., (2) 5 hrs. @ 677° C. and (3) 5 hrs. @ 760° C. Failure of the mounting material results in ring off cracking of the ceramic substrate within the canister before completion of the water quenching cycles and/or vibration times stated.

It is recognized that the mount density of mounting materials within converter assemblies is a function of the mounting gap in conjunction with the mass (weight/area) of the mounting sheet materials used. The holding forces of the mats vary with mount density and failure of the system can occur if the mount density is too low. Accordingly, mount densities which assured adequate holding of the ceramic monoliths were used. The water quench/hot vibration tests were run to test mats according to the present invention and conventional rectangular mats for their ability to inhibit ring off cracking. Of the mats tested, no ring off cracking was found in the five converter assemblies mounted with the preferred perimeter: frequency ratio of 4.88 sinusoidal edged sheets of the present invention. In contrast, ring off cracking occurred in two out of four converter assemblies mounted with identical mats having a rectangular configuration.

It will be immediately apparent to one skilled in the art that the beneficial effects obtained through the use of a resilient flexible intumescent mounting sheet corrugated with a generally sinusoidal wave pattern along both its lengthwise edges can be achieved by embossing a similar pattern 50 into the metallic casing or providing a similarly shaped insert fitting within the casing or molding or otherwise providing such a pattern 60 on the lateral surface of the ceramic catalytic element 20 itself such that mounting pressure is applied to the lateral surface of the monolith in the area circumscribed by the generally sinusoidal edges. In these modified structures, a conventional rectangular mounting sheet is wrapped about the ceramic catalytic element and the embossment on the metallic casing or the insert or the protrusion on the ceramic catalytic element would function in the same manner that the sinusoidal edges of the intumescent sheet function to distribute the vector forces in the catalytic converter 10.

What is claimed is:

1. In a catalytic converter having a metallic casing, a unitary, solid ceramic catalytic element disposed within said casing, and resilient means disposed between said catalytic element and said metallic casing for positioning said catalytic element and for absorbing mechanical and thermal shock, the improvement comprising:

said resilient means being a flexible intumescent planar sheet corrugated with a generally sinusoidal wave pattern along both its lengthwise edges, the corrugations being generally parallel and regular and comprised of substantially equal ridges and hollows having a perimeter to frequency ratio in a range of 2.44 to 4.88 and amplitude in a range of 12 to 50% of the width of said sheet.

2. The catalytic converter of claim 1 wherein the corrugations of said flexible intumescent planar sheet are sine waves and have a perimeter to frequency ratio of 4.88 and amplitude of about 25% of the width of said sheet.

3. The catalytic converter of claim 1 wherein the corrugations of said flexible intumescent planar sheet are sine waves and have a perimeter to frequency ratio of 2.44 and amplitude of about 25% of the width of said sheet.

4. The catalytic converter of claim 1 wherein the corrugations of said flexible planar sheet are sine waves with straight angular edges and have a perimeter to frequency ratio of 4.88 and amplitude of about 25% of the width of said sheet.

5. In a catalytic converter having a metallic casing, a unitary, solid ceramic catalytic element disposed within said casing, and resilient means disposed between said catalytic element and said metallic casing for positioning said catalytic element and for absorbing mechanical and thermal shock, the improvement comprising: said metallic casing having an embossed pattern comprising corrugations with a generally sinusoidal wave pattern transverse to the axis of the casing and overlying the edges of said catalytic element, the corrugations being generally parallel and regular and comprised of substantially equal ridges and hollows having a perimeter to frequency ratio in a range of 2.44 to 4.88 and amplitude in the range of 12 to 50% of the width of said sheet.

6. In a catalytic converter having a metallic casing, a unitary, solid ceramic catalytic element disposed within said casing, and resilient means disposed between said catalytic element and said metallic casing for positioning said catalytic element and for absorbing mechanical and thermal shock, the improvement comprising: said catalytic element having a protusion thereon comprising corrugations with a generally sinusoidal wave pattern transverse to the axis of said catalytic element adjacent the ends thereof, the corrugations being generally parallel and regular and comprised of substantially equal ridges and hollows having a perimeter to frequency ratio in a range of 2.44 to 4.88 and amplitude in the range of 12 to 50% of the width of said sheet.

* * * * *